US006722186B2

(12) United States Patent
Biess

(10) Patent No.: US 6,722,186 B2
(45) Date of Patent: Apr. 20, 2004

(54) METHOD AND APPARATUS FOR LOCOMOTIVE FUEL TANK REPAIR

(75) Inventor: Lawrence J. Biess, Jacksonville, FL (US)

(73) Assignee: CSX Transportation, Inc., Jacksonville, FL (US)

( * ) Notice: Subject to any disclaimer, the term of this patent is extended or adjusted under 35 U.S.C. 154(b) by 141 days.

(21) Appl. No.: 10/125,603

(22) Filed: Apr. 19, 2002

(65) Prior Publication Data

US 2002/0108227 A1 Aug. 15, 2002

Related U.S. Application Data

(62) Division of application No. 09/640,915, filed on Aug. 18, 2000, now Pat. No. 6,378,188.
(60) Provisional application No. 60/161,372, filed on Oct. 26, 1999.

(51) Int. Cl.[7] ..... G05D 7/00
(52) U.S. Cl. ..... 73/49.2; 137/15.11; 220/88.3
(58) Field of Search ..... 73/49.2; 137/15.11; 220/88.3

(56) References Cited

U.S. PATENT DOCUMENTS

| | | | | |
|---|---|---|---|---|
| 3,590,559 A | | 7/1971 | Bragg et al. | |
| 3,898,998 A | * | 8/1975 | Billberg | 220/88.3 |
| 5,176,002 A | | 1/1993 | O'Brien et al. | |
| 5,295,391 A | | 3/1994 | Mastandrea et al. | 73/49.2 |
| 5,611,366 A | | 3/1997 | Creffield et al. | |
| 5,668,308 A | | 9/1997 | Denby | |

FOREIGN PATENT DOCUMENTS

ZA 9809702 4/1999

OTHER PUBLICATIONS

Database WPI, Week 199931, Derwent Publications Ltd., London, GB; AN 1999–37521, XP002164177.
International Search Report PCT/US 00/41175 mailed Apr. 9, 2001.

* cited by examiner

*Primary Examiner*—Gerald A. Michalsky
(74) *Attorney, Agent, or Firm*—Pillsbury Winthrop LLP

(57) ABSTRACT

An embodiment of the present invention includes an apparatus for preparing a fuel tank for repairs and verifying repair work upon completion. The apparatus includes a supply system constructed and arranged to be coupled to the fuel tank for providing a supply of inert gas into the fuel tank, for purging the fuel tank of oxygen to a certain level and for making inert the fuel tank with the gas. The supply system includes a gas release system constructed and arranged to provide the supply of inert gas. The supply system further includes an arrangement for connecting and facilitating transport of the inert gas. A supply mechanism is configured and positioned to facilitate and regulate a transfer of gas from the gas release system to the fuel tank. A connector mechanism is for coupling the supply mechanism to the gas release system. A relief system is constructed and arranged to be coupled to the fuel tank to regulate and relieve pressure in the fuel tank. A plurality of connectors is for connecting the apparatus system to the fuel tank. The plurality of connectors include a first of the plurality of connectors constructed and arranged to couple the supply system to the fuel tank, and a second of the plurality of connectors constructed and arranged to couple the relief system to said fuel tank.

21 Claims, 3 Drawing Sheets

METHOD AND APPARATUS FOR LOCOMOTIVE FUEL TANK REPAIR

This is a Divisional of National application Ser. No. 09/640,915 filed Aug. 18, 2000, now U.S. Pat. No. 6,378,188, which is hereby incorporated herein by reference in its entirety.

This application claims the benefit of priority from provisional U.S. patent application 60/161,372, filed in the U.S. Patent and Trademark Office on Oct. 26, 1999, herein incorporated by reference in its entirety.

BACKGROUND OF THE INVENTION

1. Field of Invention

Aspects of the present invention generally relate to a method and apparatus for facilitating the repair of a fuel tank and testing of repair work. More specifically, aspects of the invention relate to a system and related method for preparing a fuel tank for repair by hotwork by rendering the tank non-reactive and testing the repair work upon completion by pressurizing the tank.

2. Description of Background Information

On occasion, fuel tanks acquire tears, cracks, and holes that require repair. Some repairs require the use of so-called hotwork, i.e., welding. However, when such repair work is to be completed on a fuel tank, there is always concern for the potential of a fire or explosion.

In order for a fire or an explosion to occur, three elements are required—an ignition source, fuel, and oxygen. Since welding is necessary to repair the tank, in order to avoid a fire or an explosion, elimination of either an oxygen source or a fuel source during such repair is necessary.

In the marine and petroleum industries, welding on tanks containing combustible or flammable substances is sometimes achieved by inerting the tank's atmosphere. Inertion of a tank involves blowing gas, such as carbon dioxide or nitrogen, into the tank, rendering the tank environment inactive by reducing the oxygen content by replacing it with an inert gas. To verify the repair work, the tank is ventilated and a localized air or fire hose test is performed on the repaired area. In this industry, these methods of testing repair work involve placing a human inside the tank to look for air or water leaking into the tank during such air or fire hose tests. Due to the size of these fuel tanks, it is not practical to test the entire tank.

Unlike the marine industry, the common method of repairing a fuel tank using hotwork involves draining the fuel from the tank and steaming the inside of the fuel tank, reducing the fuel hydrocarbon levels to below a lower explosive limit. This renders the tank safe for repair by hotwork.

Verifying tank repairs in the locomotive industry also differs from the marine industry. Locomotive fuel tanks are not large enough to place a human within to test repair work. One common method to verify repair work in the industry is to use a standing water test, where the repaired tank is filled with water above the repaired area and the repaired area is inspected externally for any leaking water.

In the locomotive industry, as with any industry, there is always an ongoing need to develop new methods and techniques for procedures. Thus, there remains a need in the locomotive industry to develop a method for preparing a tank for hotwork repair and testing the repair work.

In addition, each of these processes—preparing a fuel tank for repair by welding and testing the repair work—requires the use of different equipment. Currently, there is no comprehensive equipment capable of performing both of these processes to repair work. Thus, there remains a need for such equipment in the locomotive industry, as well as in other industries.

U.S. Pat. No. 3,590,559 (Bragg et al), herein incorporated by reference in its entirety, discloses an inerting system to prevent fires and explosions in fuel tanks by removing dissolved oxygen in the fuel when pressure changes within the tank.

U.S. Pat. No. 5,668,308 (Denby), herein incorporated by reference in its entirety, describes a method of detecting leaks in storage tanks by pressurizing the tank and measuring the drop in pressure over a specified time period. Similar U.S. patents exist for testing motor vehicle's evaporative fuel systems by pressuring the tank and measuring the change in pressure over time.

Currently, there remains a need for improved effective methods to prepare a locomotive fuel tank for hotwork repairs and to test the repair work. Also, there is a need for comprehensive equipment that performs both of these functions. In addition, there remains a need for an apparatus and method that allow repairs to be performed and verified back-to-back until the repair is, in fact, complete.

SUMMARY OF THE INVENTION

An embodiment of the present invention includes an apparatus for preparing a fuel tank for repairs and verifying repair work upon completion. The apparatus includes a supply system constructed and arranged to be coupled to the fuel tank for providing a supply of inert gas into the fuel tank, for purging the fuel tank of oxygen to a certain level and for making inert the fuel tank with the gas. The supply system includes a gas release system constructed and arranged to provide the supply of inert gas. The supply system further includes an arrangement for connecting and facilitating transport of the inert gas. A supply mechanism is configured and positioned to facilitate and regulate a transfer of gas from the gas release system to the fuel tank. A connector mechanism is for coupling the supply mechanism to the gas release system. A relief system is constructed and arranged to be coupled to the fuel tank to regulate and relieve pressure in the fuel tank. A plurality of connectors is for connecting the apparatus system to the fuel tank. The plurality of connectors include a first of the plurality of connectors constructed and arranged to couple the supply system to the fuel tank, and a second of the plurality of connectors constructed and arranged to couple the relief system to the fuel tank.

BRIEF DESCRIPTION OF THE DRAWINGS

The above and other objects, features, and advantages of the present invention are further described in the detailed description that follows, with reference to the following drawings wherein.

DETAILED DESCRIPTION OF THE PREFERRED EMBODIMENT

Figure 1:
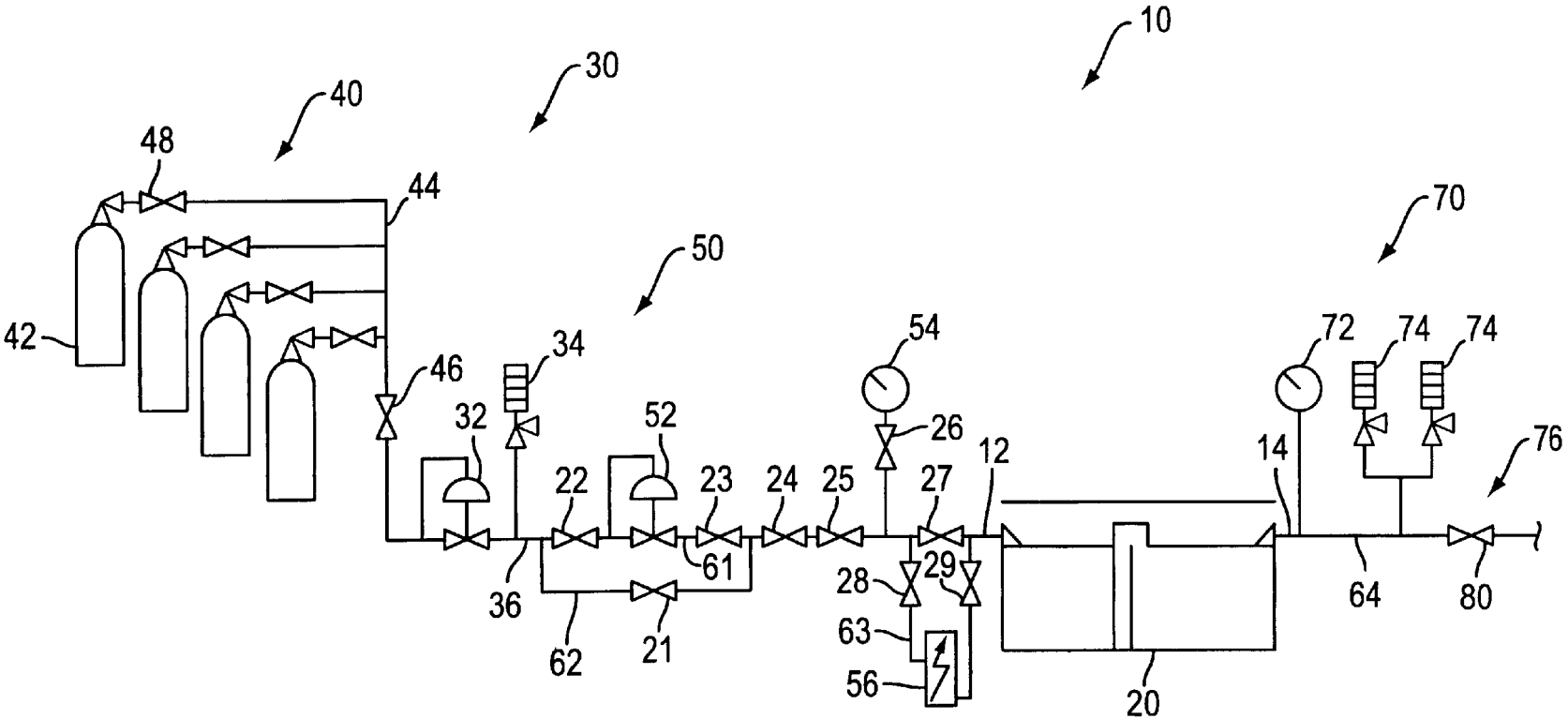
FIG. 1 is a system diagram of one embodiment of the fuel tank repair apparatus.

FIG. 1 illustrates an embodiment of an apparatus for locomotive tank repair preparation and testing in accordance with the present invention, designated generally by the reference character 10. As shown, apparatus 10 comprises a supply system, generally indicated at 30, a relief system, generally indicated at 70, and a plurality of connectors.

In this embodiment, the plurality of connectors comprises two connectors, supply side connector 12 and relief side connector 14. Supply side connector 12 and relief side connector 14 couple a fuel tank 20 to supply system 30 and relief system 70, respectively. In the illustrated embodiment, each of supply side connector 12 and relief side connector 14, is a four-foot length of hose, although other lengths can be used. One end of each hose thereof is connected to a respective fuel filler tank adapter (not shown). The fuel filler tank adapters attached to one end of each of supply side connector 12 and relief side connector 14 connect to fuel fixtures on fuel tank 20. The other end of each of supply side connector 12 and relief side connector 14 are coupled to passages on the supply system 30 and the relief system 70, respectively.

Supply system 30 comprises a connecting mechanism 36, a gas release system 40, and a supply mechanism 50. Connecting mechanism 36 in the form of a hose couples gas release system 40 to supply mechanism 50. In the illustrated embodiment, gas release system 40 comprises a gas supply 42 and a gas supply arrangement 44. To render the fuel tank's 20 environment safe for repair by hotwork, gas supply 42 is a supply of gas capable of rendering the environment of fuel tank 20 non-reactive. Gas supply 42 in this embodiment includes four full 50-lb. cylinders of nitrogen gas, but may include additional or fewer cylinders of different sizes. While nitrogen gas is used in this embodiment, other gases capable of inerting fuel tank's 20 environment are also appropriate.

Gas supply arrangement 44 includes an arrangement of valves and passages for transporting gas from gas supply 42 to fuel tank 20. Gas supply arrangement 44, in the illustrated embodiment, is a four cylinder manifold stand system for attaching four cylinders 42 of nitrogen gas to its four outlets, each cylinder and outlet having its own valve 41, with a master valve 46.

High pressure regulating mechanism 32 is coupled to gas supply arrangement 44 and high pressure relief mechanism 34. High pressure regulating mechanism 32 regulates the flow of gas passing from gas supply arrangement 44 to supply mechanism 50. High pressure relief mechanism 34 relieves pressure in supply system 30 if the pressure exceeds a particular level. In the illustrated embodiment, high pressure regulating mechanism 32 and high pressure relief mechanism 34 are a high pressure regulator and a high pressure relief valve set for 200 psi, respectively.

Supply mechanism 50 is coupled to high pressure regulating mechanism 32 with high pressure relief mechanism 34. In the illustrated embodiment, the coupling of these elements is achieved using a length of hose, such as a 15-foot long air duct hose.

In the illustrated embodiment, supply mechanism 50 comprises an arrangement of a plurality of flow control mechanisms, a plurality of passages, a supply side pressure regulating mechanism 52, a supply side pressure measuring mechanism 54, and a flow meter valve 56, as shown in FIG. 1. In the illustrated embodiment, the plurality of flow control mechanisms comprises nine valves 21, 22, 23, 24, 25, 26, 27, 28, and 29. Supply side pressure regulating mechanism 52 is a low pressure regulator. Supply side pressure measuring mechanism 54 measures the gas pressure entering fuel tank 20. In this embodiment, supply side measuring mechanism 54 is a pressure gauge and is considered the primary gauge.

In the illustrated embodiment, the plurality of passages comprises three passages 61, 62, and 63. The plurality of passages may include an arrangement of pipes, hoses, and structures that facilitate the transfer of gas to fuel tank 20. Passage 61 is coupled to high pressure relief mechanism 34, and to supply side connector 12. Passage 62 is coupled to passage 61 such that gas may flow between passage 61 and passage 62. In a similar manner, ends of passage 63 are coupled to passage 61.

As shown in FIG. 1, valves 22, 23, 24, 25, and 27 are connected in a serial configuration along passage 61. Pressure regulating mechanism 52 is also coupled to passage 61, interposed between valves 62 and 63. In this embodiment, a first end of passage 62 is connected to passage 61 between valve 22 and the end of passage 61 coupled to connecting mechanism 36. A second end of passage 62 is connected to passage 61, interposed between valves 23 and 24. Pressure measuring mechanism 54 is also coupled to passage 61 between valves 25 and 27, wherein valve 26 is coupled to pressure measuring mechanism 54 in such a way that valve 26 can regulate a flow of gas to pressure measuring mechanism 54. Passage 63 is coupled to passage 61, wherein a first end is interposed between pressure measuring mechanism 54 and valve 27 and a second end is interposed between valve 27 and an end of passage 61 attached to connector 12.

Valve 21 is coupled to passage 62. Flow meter valve 56 is coupled to passage 63. On each side of flow meter valve 56, valves 28 and 29 are coupled to passage 63.

Valves 21 along with passage 62 can prevent the movement of gas through passage 61 by being used as a bypass line around pressure regulating mechanism 52 in the illustrated embodiment. The use of this bypass feature is required during the purging process to permit flow meter valve 56 to operate at its design supply pressure. Valves 22 and 23 may be operated to isolate pressure regulating mechanism 52 from the flow of gas. Valve 26 can isolate pressure measuring mechanism 54. Valve 27 may be operated to ensure that the flow of gas travels through passage 63 and past flow meter valve 56. Meanwhile, valves 28 and 29 may be operated to isolate flow meter valve 56.

Relief system 70 comprises a pressure measuring mechanism 72, a plurality of pressure relief mechanisms 74, a flow control mechanism 76, and passage 64. Pressure measuring mechanism 72 measures the gas pressure leaving fuel tank 20. In the illustrated embodiment, pressure measuring mechanism 72 is a pressure gauge. In the illustrated embodiment, pressure measuring mechanism 72 is a secondary pressure measuring device. Pressure relief mechanism 74 comprises two low pressure relief valve in this embodiment, although more or less than two low pressure relief valves may be used. Pressure relief mechanism 74 relieves pressure in relief system 70 from fuel tank 20. It is recommended that each of pressure relief mechanism 74 be capable of relieving the full capacity of apparatus 10. Flow control mechanism 76 is a single valve 80 in this embodiment. Flow control mechanism 76 may comprise other valve or flow control configurations appropriate for controlling the pressure in fuel tank 20. Valve 80 can be operated to prevent the release of gas through passage 64 and assist apparatus 10 with pressurizing fuel tank 20.

Passage 64, in this embodiment, may include an arrangement of pipes, hoses and structures that facilitate the movement of gas from fuel tank 20. In the illustrated embodiment, one end of passage 64 is coupled to a hose end of connector 14. In this embodiment, pressure measuring mechanism 72, pressure relief means 74, and flow control mechanism 76 are coupled to passage 64 in a serial configuration wherein pressure measuring mechanism 72 is closest to the end of passage 64 connected to connector 14.

Figure 2:
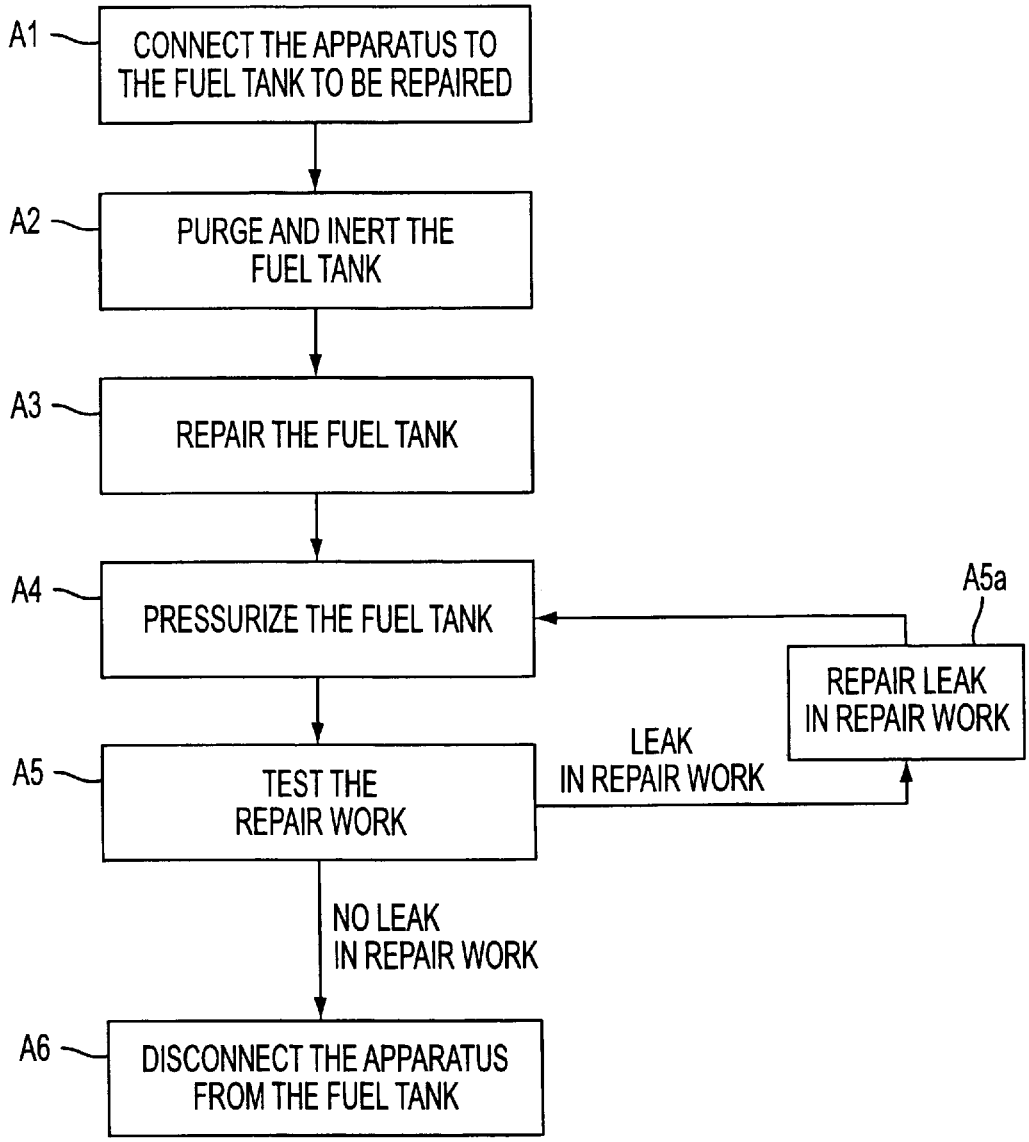
FIG. 2 is an operational flow diagram corresponding to the method implementing the fuel tank repair apparatus during both repair and testing of the repair work.

FIG. 2 generally depicts one embodiment of the method that prepares a tank for repair by hotwork and tests the repair work upon completion. This method is particularly applicable to fuel tank repair work involving small holes and cracks. However, this method can repair long tears and splits. When using this method, the remaining fuel in fuel tank 20 need not be drained prior to repair by hotwork.

In a first act A1, apparatus 10 is connected, via connectors 12 and 14, to fuel tank 20, which requires hotwork repair. In a second act A2, apparatus 10 purges the oxygen and inerts the environment of fuel tank 20, rendering the environment non-reactive by entering nitrogen gas into fuel tank 20. The fuel tank vents and/or fuel return lines must be blocked by appropriate means before inerting the environment of fuel tank 20. In the illustrated embodiment, pipe plugs, cover plates, or a combination thereof, are used to close off the fuel tank vents and return lines on fuel tank 20. Other appropriate materials for closing off the vents and fuel return lines to fuel tank 20 include a blanking plate and duct tape. Valve 80 is in an open position to allow the flow of gas to pass through supply system 30 and fuel tank 20 and out passage 64.

To complete act A2, the valve to one bottle of gas supply 42 attached to gas release system 40 and the corresponding valve on gas release system 40 are opened. Master valve 46 is then opened. The valve to high pressure regulating mechanism 32 is adjusted until the outlet pressure reads between 50–80 psig. Valves 22, 24, 25 and 27 are opened along passage 61. Valve 23 is then slowly opened. Valve 26 is opened to measure the flow of gas to fuel tank 20. This process inerts the environment of fuel tank 20 with inert gas supply 42 and purges oxygen from the same.

Once the oxygen content in the gas escaping from valve 80 measures less than six percent, valve 80 is closed during the remainder of the inertion and purging process. Oxygen content levels are measured using oxygen detecting devices; such as a cannonball gas detector. Oxygen levels within fuel tank 20 are also measured at the drain holes. The drain holes are closed after the oxygen content of the escaping gas is below six percent.

In some instances, a hole is drilled into fuel tank 20 above the remaining fuel line to assist with monitoring of oxygen levels. In the illustrated embodiment, a cannonball probe is fed through the drilled hole to measure the oxygen content of the environment of fuel tank 20. In these instances, the oxygen content measured at this hole must also register below six percent before hotwork repair may begin.

Once the oxygen levels at all gas escape points measure below six percent, valves 24, 26, and 27 are closed. Meanwhile, valves 21, 28, and 29 are opened. Valve 24 is then opened allowing inert gas to pass through passage 61 and past flow meter valve 56. In the illustrated embodiment, flow meter valve 56 is set to 80 Standard Cubic Feet/hour (SCFH). The flow of gas from inert gas supply 42 should be reduced to between 80 and 40 SCFH on flow meter valve 56. This completes act A2.

Purged of most oxygen and inerted by gas supply 42, fuel tank 20 is ready for repair work by hotwork. Such repair work is conducted by conventional methods in a next act A3. It is recommended that gas flow from gas supply 42 should be kept at a minimum, but at a level sufficient to maintain the inert and purged environment of fuel tank 20. In the illustrated embodiment, tank pressure in fuel tank 20 is maintained at 0.0 to 0.4 psig using flow meter valve 56. For purposes of safety, it is also recommended that the oxygen content nearest the repair site be tested periodically during the repair to ensure the oxygen level remains below six percent.

Upon completion of the repair work in act A3, fuel tank 20 is pressurized to test the repair work in a next act A4. Act A4 also involves preparing to pressurize fuel tank 20 by adjusting the appropriate flow control mechanisms. In the illustrated embodiment, valves 21 and 25 are closed. If a hole was drilled in fuel tank 20 above the fuel line during act A2, this hole is also closed. In the illustrated embodiment, the drilled hole is closed using a threaded plug inserted into a spud fitting welded to the top of fuel tank 20. Valves 23, 28, and 29 are also closed. Valves 24, 25, and 27 are then opened. Next, valves 23 and 26 are slowly opened. To complete the preparation for pressurizing fuel tank 20, valve 80 is closed.

Upon closing valve 80, fuel tank 20 is being pressurized. In the illustrated embodiment, fuel tank 20 is pressurized to between 1.8 and 2.0 psig and held at this pressure for at least ten minutes before testing the repair work. To assist in regulating the pressure in fuel tank 20, valve 24 is adjusted appropriately.

Once fuel tank 20 reaches and maintains the appropriate pressure level, personnel can verify the tank repairs by testing the repair work in a next act A5. In the illustrated embodiment, the inspector of the repair work conducts a visual and audible inspection. The visual inspection involves the use of a "snoop" or equivalent soap bubble solution to wet the repaired area, wherein the inspector would look for bubbles that indicate a leak in the repaired area. During an audible inspection, the inspector checks for leaking gas using the back of his or her hand. Other appropriate conventional inspection methods may be used to verify the repair work.

If a leak is found during act A5, corrective repair work can immediately follow in a further act A5*a* upon closing valves 25 and 26 and opening valve 80. When the corrective repair work is complete, valves 25 and 26 are reopened and valve 80 is closed to repressurize fuel tank 20, as described in act A4. The corrective repair work can be tested in an appropriate manner, such as those methods suggested in act A5. This corrective repair process can be repeated iteratively until the repair work is complete. An advantage to this method is the repeated ability to verify repair work and immediately take corrective action, if necessary, until the repair is complete.

In a next act A6, repaired fuel tank 20 is vented, allowing the gas to escape from fuel tank 20. In the illustrated embodiment, valve 24 is slowly closed and valve 80 is opened. Valves to the bottles of gas supply 42 are then closed; valves 21, 22, 23, 24, 25, 27, and 80 are open; valves 26, 28, and 29 are closed; high pressure regulating mechanism 32 is set for 50 psig; and pressure regulating mechanism 52 is set to 2–3 psig. After apparatus 10 is appropriately adjusted, the fuel tank plugs and tank vent cover are removed. Then, apparatus 10 may be disconnected from fuel tank 20, and fuel tank 20 is assembled appropriately for normal use.

Figure 3:
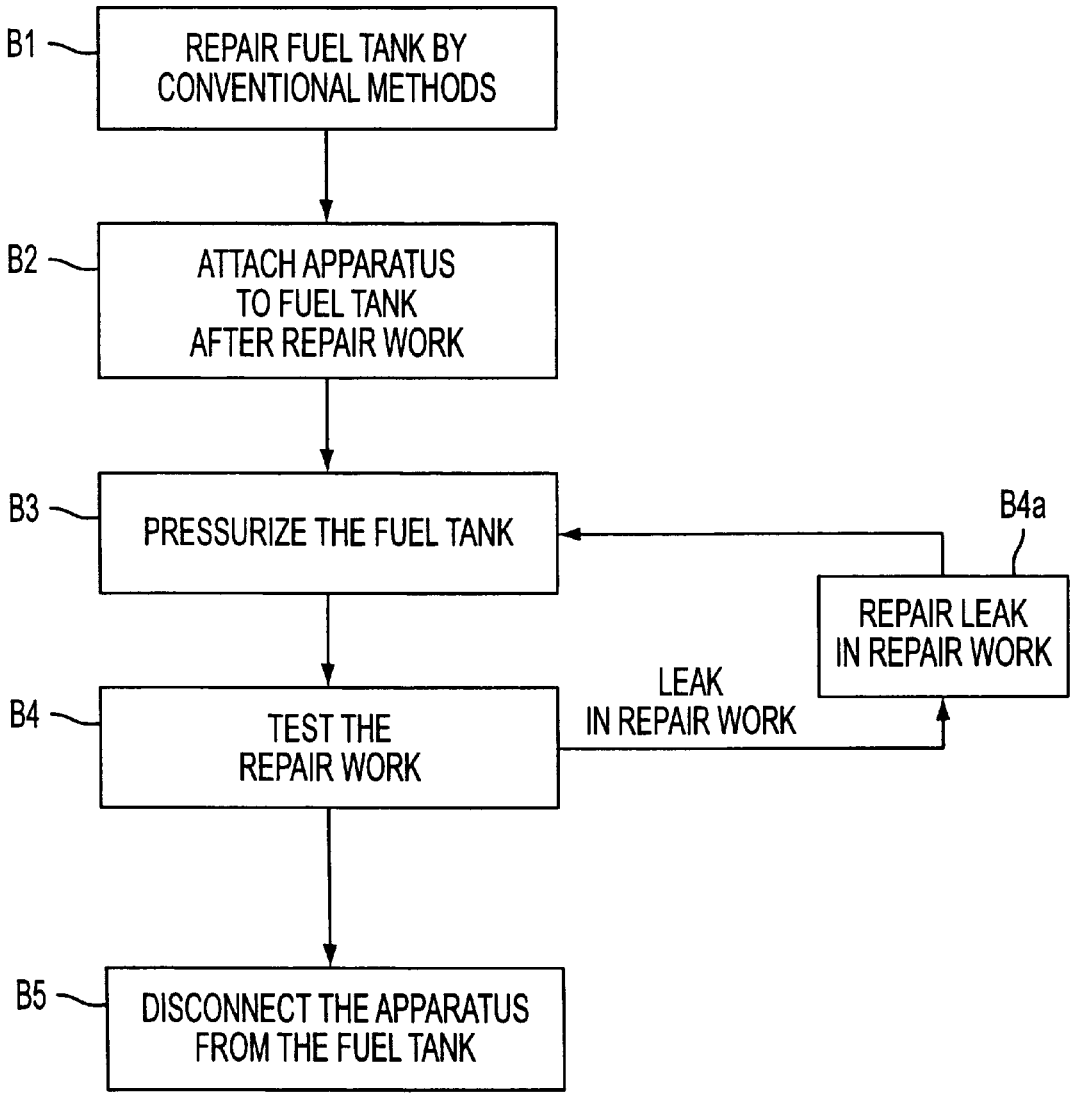
FIG. 3 is an operational flow diagram corresponding to the method implementing the fuel tank repair apparatus during the testing of the repair work.

A user of the above described method may also opt to implement only one aspect of the invention, namely the preparation of fuel tank 20 for repair by hotwork or testing of repair work. FIG. 3 generally depicts one embodiment of a user employing apparatus 80 and the method for testing repair work. In a first act B1, fuel tank 20 is repaired by conventional methods, such as draining the remaining fuel and steaming fuel tank 20 to reduce hydrocarbon levels in fuel tank 20 to less than the lower explosive limit. In a second act B2, apparatus 10 is attached to repaired fuel tank 20 as in act A1 in FIG. 2. With apparatus 10 connected to repaired fuel tank 20, repaired fuel tank 20 is pressurized in a next act B3, in a manner in accordance with act A4. In a next act B3, the repair work on fuel tank 20 is tested in the same manner as act A5. If a leak is found, corrective repair work may be undertaken immediately and retested in act B4*a*, as described above in act A5*a*. Upon completion of the repair and verification of the repair work, apparatus 80 should be disconnected in act B5 in the same manner as set forth above in act A6 above.

While the detailed description relates to a locomotive fuel tank repair work, the present invention is relevant to all fuel tank repair work. While the invention has been described by way of an example embodiment, it is understood that the words that have been used herein are words of description, rather than words of limitation. Changes may be made, within the purview of the appended claims, without departing from the scope and spirit of the invention in its broader aspects. Although the invention has been described herein with reference to particular structures, materials, and embodiments, it is understood that the invention is not limited to the particulars disclosed. The invention extends to all equivalent structures, mechanisms, acts and uses, as are within the scope of the appended claims.

What is claimed:

1. An apparatus for preparing a fuel tank for repairs and verifying repair work upon completion, said apparatus comprising:

a supply system constructed and arranged to be coupled to said fuel tank to provide a supply of inert gas into said fuel tank to purge said fuel tank of oxygen to a certain level and to inert said fuel tank with said gas, wherein the certain level of oxygen is maintained during performance of repair work, the repair work being associated with an area of said fuel tank, said supply system including a gas release system constructed and arranged to provide said supply of inert gas and including an arrangement to connect and facilitate transport of said inert gas, a supply mechanism configured and positioned to facilitate and regulate a transfer of gas from said gas release system to said fuel tank, and a connector mechanism to couple said supply mechanism to said gas release system;

a relief system constructed and arranged to be coupled to said fuel tank to regulate and relieve pressure in said fuel tank; and a plurality of connectors, a first of said plurality of connectors constructed and arranged to couple said supply system to said fuel tank, and a second of said plurality of connectors constructed and arranged to couple said relief system to said fuel tank wherein said supply system comprises an arrangement of a pressure regulating mechanism, a flow measuring mechanism, and a pressure measuring mechanism along at least one passage to carry said gas, and wherein said supply system further comprises at least one flow control mechanism that is configured and positioned to isolate each of said pressure regulating mechanism, flow measuring mechanism, and pressure measuring mechanism from the at least one passage and from the other of said pressure regulating mechanism, flow measuring mechanism, and pressure measuring mechanism.

2. The apparatus according to claim 1, wherein said certain level of oxygen is below about 6 percent.

3. The apparatus according to claim 1, wherein said arrangement is a manifold system.

4. The apparatus according to claim 1, wherein said inert gas is nitrogen gas.

5. The apparatus according to claim 1, wherein said certain level of oxygen is below about 6 percent, said arrangement is a manifold system, and said supply of inert gas is nitrogen gas.

6. The apparatus according to claim 1, wherein said supply system further comprises a high pressure regulating mechanism.

7. The apparatus according to claim 1, wherein said supply system further comprises a high pressure relief mechanism.

8. The apparatus according to claim 1, wherein said connectors comprise a length of hose with a fuel filler cap tank adapter attached to an end of each length of hose.

9. The apparatus according to claim 1, wherein said supply system is coupled to said fuel tank opposite where said relief system is coupled to said fuel tank.

10. The apparatus according to claim 1, wherein said fuel tank is a locomotive fuel tank.

11. The apparatus according to claim 1, wherein said flow control mechanism is a valve.

12. The apparatus according to claim 1, wherein said flow measuring mechanism is a flow meter valve.

13. The apparatus according to claim 1, wherein said pressure measuring mechanism is a pressure gauge.

14. The apparatus according to claim 1, wherein said pressure regulating mechanism is a pressure regulator.

15. The apparatus according to claim 1, wherein said flow control mechanism is a valve, said flow measuring mechanism is a flow meter valve, said pressure measuring mechanism is a pressure gauge, and said pressure regulating mechanism is a pressure regulator.

16. The apparatus according to claim 1, wherein said relief system comprises an arrangement of at least one flow control mechanism and pressure measuring mechanism along at least one passage to carry said gas.

17. The apparatus according to claim 16, wherein said relief system further comprises a pressure relieving mechanism along said at least one passage.

18. The apparatus according to claim 17, wherein said pressure relieving mechanism is a pressure relief valve.

19. The apparatus according to claim 16, wherein said flow control mechanism is a valve.

20. The apparatus according to claim 16, wherein said pressure measuring mechanism is a pressure gauge.

21. The apparatus according to claim 16, wherein said relief system further comprises a pressure relieving mechanism along said at least one passage, said flow control mechanism is a valve, and said pressure measuring mechanism is a pressure gauge.

* * * * *